United States Patent [19]

van Zalinge

[11] 4,242,938

[45] Jan. 6, 1981

[54] STRINGED MUSICAL INSTRUMENT

[76] Inventor: Henk van Zalinge, Schapendrift 84, Blaricum, Netherlands

[21] Appl. No.: 969,460

[22] Filed: Dec. 14, 1978

[51] Int. Cl.[3] ..... G10D 1/02; G10H 3/00

[52] U.S. Cl. ..... 84/1.16; 84/275; 84/277; 84/291

[58] Field of Search ..... 84/1.14, 1.15, 1.16, 84/275, 276, 277, 291

[56] References Cited

U.S. PATENT DOCUMENTS

| | | | |
|---|---|---|---|
| 129,653 | 7/1872 | Collins | 84/275 |
| 1,383,830 | 7/1921 | Leighton | 84/277 |
| 1,475,423 | 11/1923 | Brann | 84/277 |
| 1,773,133 | 8/1930 | Faccaro | 84/275 |
| 1,834,804 | 12/1931 | Puoina | 84/291 |
| 1,861,717 | 6/1932 | Pfeil | 84/1.16 |
| 1,900,489 | 3/1933 | Eisenberg | 84/1.16 |
| 2,145,237 | 1/1939 | Eberhart | 84/277 |
| 2,223,190 | 11/1940 | Smith | 84/1.16 |
| 2,370,460 | 2/1945 | Patmor | 84/277 |
| 3,325,580 | 6/1967 | Barcus et al. | 84/1.14 |
| 3,538,807 | 11/1970 | Francis | 84/1.16 |
| 3,833,751 | 9/1974 | Chapman | 84/1.16 |
| 4,149,442 | 4/1979 | Boshco | 84/1.16 |

*Primary Examiner*—Stanley J. Witkowski
*Assistant Examiner*—Forester W. Isen
*Attorney, Agent, or Firm*—Kane, Dalsimer, Kane, Sullivan and Kurucz

[57] ABSTRACT

A stringed musical instrument, in particular a double bass, having a resonating body of narrow elongate shape, a neck secured to this body and strings extending across the body and neck and across a bridge supported on the front plate of the body. A transverse sound-beam inside the body divides the latter into two separate resonating chambers of unequal size which are acoustically connected by a through-hole in the sound-beam. Below the bridge a bore extends through the body front plate and into the sound-beam to open into the connecting hole of the beam and an electrical pick-up element extends through this bore between the lower side of the bridge and a vibration plate mounted in the connecting hole.

9 Claims, 4 Drawing Figures

STRINGED MUSICAL INSTRUMENT

BACKGROUND OF THE INVENTION

The invention relates to a stringed musical instrument, and in particular to a double bass, of the type comprising a resonating body formed by a front plate, back plate and side ribs, a neck secured to the body, a bridge supported on the front plate, and strings extending across the body and neck and stretched across the bridge. More particularly the invention relates to such a stringed musical instrument having an electrical pick-up element mounted between the bridge and a part of the body for connection to an electrical amplifier and loudspeaker system.

The use of an electrical pick-up element in a stringed musical instrument having a body or resonating box of conventional form and design leads in many cases not to a satisfying result because certain overtones and parasitic vibrations are unequally amplified. This is particularly the case in a double bass which instrument often has a strong tendency to produce specific tones relatively weak or relatively strong which causes an unbalanced sound and may lead to reaction coupling effects.

SUMMARY OF THE INVENTION

The invention has for its object to provide an improved stringed musical instrument of the above-described kind which at least substantially obviates these draw-backs and, apart from this, presents furthes advantages as mentioned below. The invention is applicable in stringed musical instruments of various type, such as violins, cellos, guitars etc., but has shown to be particularly advantageous in the case of a double bass.

The stringed musical instrument according to the invention has a body of narrow elongate shape and comprises a transverse sound-beam arranged in the body dividing the latter into two separate resonating chambers of unequal size which sound-beam extends across the whole width of the body between the side ribs thereof and fittingly engages the inner sides of the front plate and back plate of the body. The sound-beam has at least one hole formed therein extending in the longitudinal direction of the body to connect said two resonating chambers, the bridge being supported on the front plate at said sound-beam.

It has been shown that a stringed musical instrument having a box of the above-described structure makes it possible to realize a balanced amplification of all tones within the complete range of the instrument, allowing tones of exactly the right pitch and the desired strength to be produced without the occurence of any reaction coupling effects. The instrument reacts readily, also in the higher ranges of the low strings, as is particularly important for a double bass since conventional instruments of this type often show a dead spot in this range. An other great advantage is that because of the simple shape of the box the instrument can be easily handled and transported, which again is of particular importance for a double bass, while furthermore the design of the box allows a relatively sturdy construction whereby the instrument is less vulnerable to shocks and also less sensitive to weather influences.

The ratio between the volumes of the two resonating chambers lies generally between 1:2 and 1:3, depending on the shape of the box and the type of the instrument; within these limits the best location of the transverse sound-beam can be determined by experiment. For a double bass this ratio is preferably approximately 2:5.

Preferably, the resonating chamber adjacent the neck of the instrument has a larger volume than the resonating chamber remote from the neck.

The front plate of the body may be left unperforated in the areas thereof covering the two resonating chambers whereby the strength of the box is improved. However it may be required to drill a small hole in one or more locations of the front plate, to be determined by experiments, if this should appear desirable to improve the sound of certain tones.

The pick-up element may be mounted with its upper end against the lower side of the bridge in the middle thereof, the element extending from its upper end downwardly through a bore formed in the front plate and in the sound-beam perpendicularly to the front plate and opening into the connecting hole in the sound-beam, the lower end of the pick-up element finding support in this hole. The pick-up element thus receives vibrations from two sides, that is from the bridge and from the sound-beam arranged between the two resonating chambers. Preferably, a vibration plate is mounted in the sound-beam extending across the hole therein, the lower end of the pick-up element being supported on this vibration plate.

The pick-up element itself can be of any suitable known design and may comprise a piezo-electric transducer.

Because of the sturdy construction of the box of the instrument it is possible to detachably secure the neck of the instrument to the body if this is considered desirable to facilitate the transportation of the instrument.

BRIEF DESCRIPTION OF THE DRAWINGS

The invention will be explained in further detail with reference to the drawings which show a preferred embodiment thereof.

DESCRIPTION OF THE PREFERRED EMBODIMENT

Figure 2:
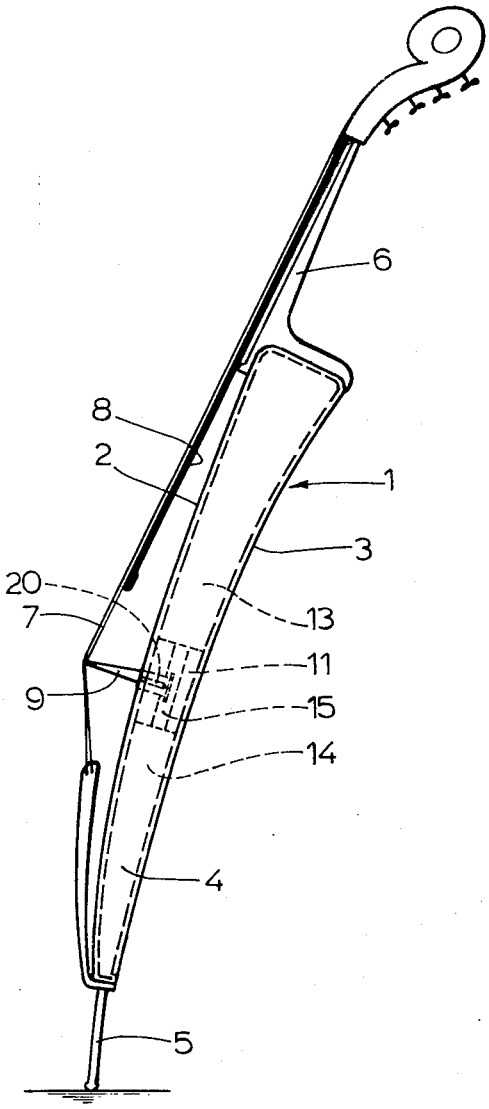
FIG. 2 is a side view of the double bass of FIG. 1.
Figure 3:
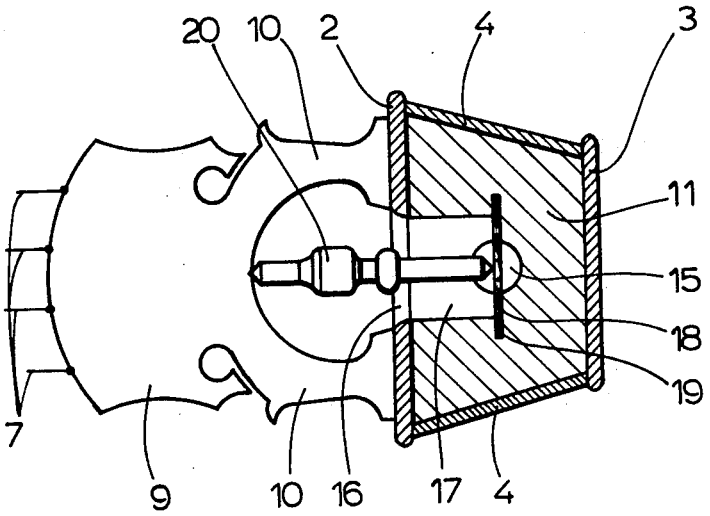
FIG. 3 is, on an enlarged scale, a cross-section on the line III—III of FIG. 1.

In the drawings there is shown a double bass having a wooden body 1 comprising a front plate 2, a back plate 3 and side walls or ribs 4. The body 1 has a narrow elongate shape with longitudinally extending curved ribs, as seen in the front elevation of FIG. 1, the body 1 having its greatest width approximately midway of its lengths and the ribs 4 converging therefrom towards the upper and lower end of the body. As seen in the side elevation of FIG. 2, the front plate 2 and the back plate 3 are slightly curved, the body having its smallest height at its lower end and the plates 2 and 3 slightly diverging upwardly from that end. As can be seen in FIG. 3, the plates 2 and 3 are straight in cross-section and the ribs 4 extend obliquely downwardly and inwardly from the front plate 2 to the back plate 3, the body thus having in cross-section the shape of a symmetrical trapezium. Except for an opening 16 as mentioned below, the front plate 2, like the back plate 3, presents a closed surface. However, it is possible to provide the front plate 2 with one or more drilled holes in suitable locations if this appear to be desirable for improving the quality of certain tones (not shown).

A metal support 5 of conventional design is secured to the lower end of the body 1 and a neck likewise of conventional design is secured to the upper end of the body which parts 5 and 6 may be detachable if so desired for ease of transportation. The strings 7 of the instrument are again arranged and attached in the conventional manner and extend along a finger-board 8 secured to the neck 6. The strings 7 are stretched across a bridge 9 having two leg portions 10 which support the bridge 9 on the front plate 2 of the body 5.

Figure 4:
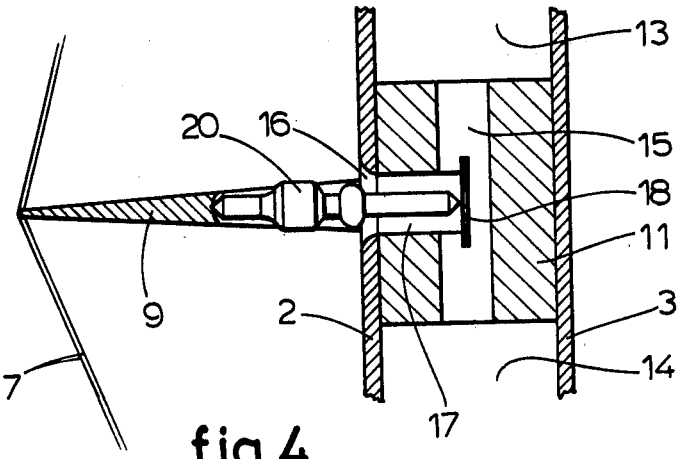
FIG. 4 is, on the same scale as FIG. 3, a longitudinal section of the box at the location of the bridge and the sound-beam.

A wooden sound-beam 11 is arranged transversely inside the closed hollow body 1 at the spot where the legs 10 of the bridge 9 are resting on the front plate 2 and where the body 1 has approximately its greatest width. The sound-beam 11 extends across the whole width of the body 1 closely fitting between the opposite side ribs 4 and between the front plate 2 and back plate 3, as shown in FIG. 3. The beam 11 can be secured to these ribs 4 and plates 2 and 3 by gluing. As seen in the longitudinal direction of the body 1, the thickness dimension of the sound-beam 11 is several times greater than the thickness of the bridge legs 10 (FIG. 4).

The sound-beam 11 thus divides the body 1 into two separate resonating chambers 13 and 14, the chamber 13 having a greater volume than the chamber 14. For the depicted double bass the ratio between the volumes of the two chambers 13 and 14 is approximately 5:2 in which the chamber 13 of greater volume is situated at the upper side of the body 1 adjacent the neck 6.

About midway of its length the sound-beam 11 is provided with a cylindrical through-hole 15 extending in the longitudinal direction of the body 1 and acoustically connecting the two resonating chambers 13 and 14.

An opening 16 of oval shape has been cut out in the front plate 2 between the legs 10 of the bridge 9 and the sound-beam 11 has a bore 17 in continuation of the opening 16. The bore 17 opens into the hole 15 and extends approximately up to the axis of this hole. The width of the bore 17, as seen in the cross-section of FIG. 3, is greater than the width or diameter of the cylindrical hole 15. A pick-up element 20 of known type and comprising a piezo-electric transducer is mounted in the space between the bridge legs 10 and extends into the bore 17. The element 20 has two pointed ends, one of which engages the lower side of the bridge 9 midway between the bridge legs 10 and the other of which engages a vibration plate 18 which is mounted at the bottom of the bore 17 in a position extending diametrically across the hole 15. Opposite ends of the vibration plate 18 are secured in grooves 19 formed in the body of the sound-beam 11.

Although the pick-up element 20 is preferably supported on a vibration plate 18 in the above-described manner, it is also possible to support this pick-up element 20 with its lower end directly on the lower wall of the connection hole 15.

It will be understood, that within the scope of the invention the shape and design of the body 1 of the instrument can be varied in which the correct position of the transverse sound-beam 11 and the ratio of the volumes of the two resonating chambers 13 and 14 should of course be adapted to the shape of the body and can be further determined by experiment. This is also the case for the size of the connection hole 15 providing the acoustical coupling between the two resonating chambers 13 and 14.

Other stringed musical instruments, such as cellos, violins and guitars, can be built according to the same principle as above-described for a double bass in which obviously the size and design of the instrument body must be chosen accordingly.

Figure 1:
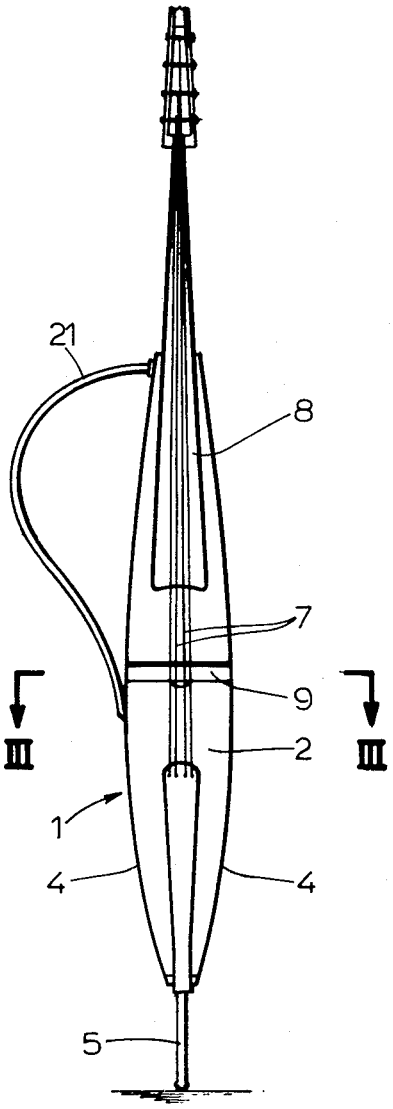
FIG. 1 is a front elevation of a double bass constructed in accordance with the invention.

As shown in FIG. 1, a metal bow 21 can be secured to one side of the body 1 which bow is preferably detachable. This bow can be used to support the instrument against the body of the player to hold the instrument in the proper position during playing.

What is claimed is:

1. A stringed musical instrument comprising a resonating body formed by a front plate, back plate and side ribs, said body having a narrow elongate shape; a neck secured to the body; a bridge supported on the front plate; strings extending across the body and neck and stretched across the bridge; an electrical pick-up element associated with said bridge for connection to an electrical amplifier and loudspeaker system; and a transverse sound-beam arranged in and forming part of said body, dividing the latter into two separate resonating chambers of unequal size, said sound-beam extending across the whole width of the body between the side ribs thereof and fittingly engaging the inner sides of the front plate and back plate of the body, and said sound-beam having a first bore formed therein extending in the longitudinal direction of the body connecting said two resonating chambers, said bridge being supported on the front plate at said sound-beam, and said pick-up element being mounted between and engaging said bridge and said body at said sound-beam.

2. The stringed musical instrument of claim 1, in which the ratio between the volumes of said two resonating chambers lies between 1:2 and 1:3.

3. The stringed musical instrument of claim 2, in which one of said two resonating chambers is located adjacent the neck of the instrument and has a larger volume than the other of said two resonating chambers located remote from the neck.

4. The stringed musical instrument of claim 1, in which the front plate of the body is unperforated in the areas thereof covering said two resonating chambers.

5. The stringed musical instrument of claim 1, in which said body has in cross-section the shape of a trapezium.

6. The invention as described in claim 1 wherein said stringed musical instrument is a double bass.

7. The invention as described in claim 6 wherein the ratio between the volumes of said two resonating chambers is approximately 2:5.

8. A stringed musical instrument comprising a resonating body formed by a front plate, back plate and side ribs, said body having a narrow elongate shape; a neck secured to the body; a bridge supported on the front plate; strings extending across the body and neck stretched across the bridge; an electrical pick-up element associated with said bridge for connection to an electrical amplifier and loudspeaker system; and a transverse sound-beam arranged in and forming part of said body, dividing the latter into two separate resonating chambers of unequal size, said sound-beam extending across the whole width of the body between the side ribs thereof and fittingly engaging the inner sides of the front plate and back plate of the body, said sound-beam having a first bore formed therein extending in the longitudinal direction of the body connecting said two resonating chambers, said bridge being supported on the front plate at said sound-beam, a second bore extending through said front plate and into said sound-beam in a direction perpendicular to the front plate to open into said first bore in said sound-beam, said pick-up element being mounted with its upper end engaging the lower side of said bridge in the middle thereof, said element extending longitudinally from said upper end downwardly through said second bore, the lower end of the pick-up element finding support in said first bore.

9. A stringed musical instrument as claimed in claim 8, further comprising a vibration plate mounted in said sound-beam extending across said first bore therein, said lower end of said pick-up element being supported on said vibration plate.

* * * * *